United States Patent [19]

Molmans

[11] Patent Number: 4,828,730

[45] Date of Patent: May 9, 1989

[54] ALKALI METAL ALUMINUM SILICATE CONTAINING METAL WORKING FLUID COMPOSITIONS AND PROCESSES FOR MACHINING METAL EMPLOYING SUCH COMPOSITIONS

[75] Inventor: Albertus M. H. Molmans, XJ Leiden, Netherlands

[73] Assignee: Cincinnati Milacron Inc., Cincinnati, Ohio

[21] Appl. No.: 124,211

[22] Filed: Nov. 23, 1987

[51] Int. Cl.[4] ..... C10M 125/26; C10M 173/00

[52] U.S. Cl. ..... 252/28; 252/49.3; 252/49.5

[58] Field of Search ..... 252/28, 49.3, 49.5

[56] References Cited

U.S. PATENT DOCUMENTS

| | | | |
|---|---|---|---|
| 3,350,307 | 10/1967 | Brown et al. | 252/49.5 |
| 3,375,729 | 4/1968 | Brown et al. | 252/49.3 |
| 3,522,177 | 7/1970 | Benz | 252/49.5 |
| 3,798,174 | 3/1974 | Acker et al. | 252/28 |
| 3,801,504 | 4/1974 | Stone | 252/49.5 |
| 4,329,238 | 5/1982 | Mitrofanova et al. | 252/28 |
| 4,419,250 | 12/1983 | Allen et al. | 252/8.6 |
| 4,421,657 | 12/1983 | Allen et al. | 252/8.6 |
| 4,472,287 | 9/1984 | Ramachandran | 252/8.6 |
| 4,569,773 | 2/1986 | Ramachandran | 252/8.6 |
| 4,676,915 | 6/1987 | Steltenkamp et al. | 252/8.8 |
| 4,715,862 | 12/1987 | Stelenkamp et al. | 252/8.8 |
| 4,715,970 | 12/1987 | Stelenkamp et al. | 252/8.8 |

FOREIGN PATENT DOCUMENTS

| | | |
|---|---|---|
| 767046 | 7/1951 | Fed. Rep. of Germany . |
| 1444556 | 5/1973 | Fed. Rep. of Germany . |
| 881273 | 1/1943 | France . |
| 1473201 | 5/1977 | United Kingdom . |
| 1581345 | 12/1980 | United Kingdom . |

*Primary Examiner*—William R. Dixon, Jr.
*Assistant Examiner*—Ellen McAvoy
*Attorney, Agent, or Firm*—C. Richard Eby

[57] ABSTRACT

Use is made of crystalline alkali metal aluminum silicates of the zeolite type, having the formula $(A_2O)_x \cdot Al_2O_3 \cdot (SiO_2)_y$ wherein A=alkali metal, x has a value of 0.7–1.5 and y has a value of 0.8–4 and having a particle size between 0.1 and 100 μm in an aqueous metal working fluid composition.

11 Claims, No Drawings

ALKALI METAL ALUMINUM SILICATE CONTAINING METAL WORKING FLUID COMPOSITIONS AND PROCESSES FOR MACHINING METAL EMPLOYING SUCH COMPOSITIONS

The invention relates to metal working fluid compositions which are applied in machining and grinding metal parts, e.g. in cutting, turning, milling, drilling of metal parts.

Oil based and aqueous metal working fluids have been known for a long time in the art and in metal working processes. Such fluids are known in the art to have lubricating and cooling functions which reduce friction and dissipate heat in metal working processes. This reduction of friction and dissipation of heat promotes long tool life, increases production and allows the attainment of high quality finished metal products. Especially aqueous metal working fluids are to-day used on a large scale; they combine a good lubricating and cooling effect with a reduced fire risk, are cheap and give less pollution problems when the spent fluids have to be discarded.

These aqueous metal working fluids may be of various types. Oil-in-water emulsions form the major part of the aqueous metal working fluids, but aqueous compositions comprising a continuous water phase with a small amount of a solubilized organic phase or true solutions of a small amount of organic components in water are also used.

The organic component in these aqueous metal working fluids can be a mineral or synthetic oil or may comprise synthetic compounds, like for example esters of polyhydroxy compounds, alkanolamides and alkanolamine salts, which are non-oily but have lubricating properties.

Besides water and the oil or organic lubricating component, emulsifiers, solubilizing agents, corrosion inhibitors and further additives may be present.

Typical of the prior art in this field are oil-in-water emulsions, compositions with a solubilized and/or dissolved organic phase comprising sorbitan fatty cid esters and alkylolamides of fatty acids as the organic component with lubricating properties and comprising erythritol or glycerol esters of fatty acids as emulsifiers, compositions which are solutions of salts of alkanolamines and compositions comprising water and esters of a polyoxyalkylene diol and a dicarboxylic acid as the organic component having lubricating properties.

Generally a concentrate, with or without water, comprising the organic component having lubricating properties and additional components, is marketed, said concentrates being diluted with water by the user to a use composition for machining metal.

In practice new dilution of a concentrate often gives problems, because the quality of the water used for diluting the concentrate may very considerably. Especially the hardness of the water source has a great influence on the properties of the aqueous metal working fluid. It is possible to cope with this problem or at least to reduce it considerably by softening the water on the spot by any of the usual softening methods, but even then the water still contains small amounts of calcium and/or magnesium ions which may concentrate in the metal working fluid, by evaporation and replenishing with fresh (softened) water. Therefore it is usual to incorporate into the concentrate a suitable amount of a chelating agent or sequestering agent, such as alkali metal, ammonium or amine salts of polycarboxylic acids like citric acid and tartaric acid, alkylene polyamine acetic acids, like EDTA, salts of nitrilo triacetic acid or polyphosphate to bind the calcium and magnesium ions which are responsible for the hardness.

Aqueous metal working fluid compositions which comprise such chelating or sequestering agents, however, often give problems in that the metal parts which have been machined stock together by dried deposits formed by such compositions. Further these compositions are harsh and the stability of the compositions appears to be insufficient. Often these compositions give problems with scum formation which prevents the machining or grinding process to be visually followed and phase separation between water and organic compounds may appear, resulting in the formation of a precipitate on the surfaces of tools and metal parts, which precipitate is difficult to remove.

Surprisingly, it was now found that crystalline alkali metal aluminum silicates of the zeolite type having the formula $$(A_2O)_x.Al_2O_3.(SiO_2)_y$$

wherein A=alkali metal, x has a value of 0.7–1.5 and y has a value of 0.8–4 and having a particle size between 0.1 and 100 μm, when incorporated into aqueous metal working fluid compositions instead of chelating or sequestering agents, produces a reduced tendency for sticking of metal parts and gives an improved stability, especially when the water used has a hardness of more than 200 ppm, calculated as $CaCO_3$, (11.2 GH) the total composition more over being less harsh.

Typical crystalline alkali metal aluminum silicates used in this invention are of the type known as zeolite A. Crystalline alkali metal aluminum silicates of the above mentioned type are known per se, as builders fo use in detergent compositions.

These crystalline alkali metal aluminum silicates must be incorporated in the dispersed form into the aqueous metal working fluid composition which is otherwise ready for use. If the alkali metal aluminum silicates are incorporated into the concentrates, a lumpy mass is obtained which cannot be dispersed in water. In a preferred practice of this invention the aqueous metal working fluid composition, in which the alkali metal aluminum silicate is incorporated contains at least 80% by weight of water based on the total composition. Aqueous metal working fluid compositions in accordance with this invention may contain from 90 to 99% by weight of water based on the total composition.

The invention thus relates to crystalline alkali metal aluminum silicates of the zeolite type having the formula $$(A_2O)_x.Al_2O_3.(SiO_2)_y$$

wherein A, x and y have the above-mentioned meaning and having a particle size between 0.1 and 100 μm, in an aqueous metal working fluid composition.

The aqueous metal working fluid composition can be of any usual type with or without chelating or sequestering agents.

The amount of crystalline alkali metal aluminum silicate used in the metal working fluid composition according to this invention can vary between 0.05 and 1% by weight, preferably between 0.1 and 0.5% by weight, calculated on the total aqueous metal working fluid composition. An amount of less than 0.05% does not give a sufficient effect; an amount of more than 1% does not improve the effect but leads to heavy deposits which must be washed away.

Preferably the particle size of the crystalline alkali metal aluminum silicate is between 0.1 and 15 μm, in particular smaller than 10 μm. Crystalline alkali metal aluminum silicates of this particle size have the best effect, probably because the particle size is adjusted on the zeolite properties of the aluminum silicate.

A particularly good effect is obtained, if the crystalline alkali metal aluminum silicate has the composition $$(0.7\text{–}1.1)Na_2O.Al_2O_3.(1.3\text{–}2.4)SiO_2$$

then the stability of the aqueous metal working fluid compositions is best.

The invention also relates to a process for machining and grinding metal parts wherein a continuous stream of an aqueous metal working fluid composition is supplied in the area where the machining tools act upon the metal parts, as is generally known from the prior art.

The process of this invention is however characterized in that an aqueous metal working fluid composition is applied wherein a crystalline alkali metal aluminum silicate of the zeolite type, having the formula $$(A_2O)_x.\ Al_2O_3.(SiO_2)_y$$

wherein A, x and y have the above-mentioned meanings, and having a particle size between 0.1 and 100 μm has been incorporated therein and preferably such a composition wherein the preferred aluminum silicates, in the preferred amounts, as indicated above, have been incorporated.

The invention is elucidated by the following examples wherein all amounts of materials are by weight unless otherwise indicated. In the examples 4 types of aqueous metal working fluid compositions were used which were obtained by diluting the following specific concentrates with water of a standard composition with a nominal hardness of 410 ppm calculated as Ca $CO_3$ and prepared by mixing 18.5 ml of standard calcium chloride solution according to DIN 51360 and 4.5 ml of standard magnesium sulfate solution according to DIN 51360 and diluting the mixture with distilled water to a volume of 1 liter.

The specific concentrates used are typical for the general types indicated in the table.

| | COMPOSITION CONCENTRATES, PARTS BY WEIGHT | | | | | | | |
|---|---|---|---|---|---|---|---|---|
| | Type 1 | | Type 2 | | Type 3 | | Type 4 | |
| Component | General | Specific | General | Specific | General | Specific | General | Specific |
| Water | 45–50 | 45.9 | 70–75 | 72.0 | 65–70 | 68.2 | 65–70 | 67.0 |
| Mineral Oil | 30–53 | 30.6 | — | — | 5–10 | 8.4 | 10–15 | 10.0 |
| O. Boric acid | 5–10 | 5.1 | 5–10 | 10.0 | 5–10 | 7.3 | — | — |
| Fatty acids | 4–6 | 4.5 | — | — | 2–4 | 2.1 | 2–4 | 3.0 |
| Triazine derivative | 2–4 | 2.3 | — | — | 2–4 | 2.8 | 1–3 | 1.4 |
| Petroleum sulfonate | 3–5 | 4.1 | — | — | 3–5 | 4.2 | — | — |
| Ethoxylated nonylphenol | 1–3 | 2.1 | — | — | 1–2 | 0.3 | 5–7 | 6.0 |
| Alkanolamine | 3–5 | 3.5 | 9–11 | 10.5 | 3–5 | 4.4 | 4–6 | 5.3 |
| Alkylsulfonamide | — | — | — | — | — | — | 4–6 | 5.0 |
| Ester of fatty acids | — | — | 1–2 | 1.0 | — | — | — | — |
| Esters of dimeric acids | — | — | 2–3 | 2.0 | — | — | — | — |

As the crystalline alkali metal aluminum silicate of the zeolite type was used a sodium aluminum silicate of nominal composition $$Na_2O.Al_2O_3.2SiO_2$$

variation in composition between $0.9\text{–}1.0Na_2O.Al_2O_3.1.8\text{–}2.2SiO_2$ having a particle size between 0.1 and 10 μm (SAS).

EXAMPLE 1

Concentrates 1, 2 and 3 were diluted with water of standard composition as indicated above to a concentration of 5% To these aqueous metal working fluid compositions were added varying amounts of SAS. The compositions were mild to the skin and could be safely handled. The influence of SAS on the hardness of the compositions was determined with the following results.

| Conc. SAS (% weight) | Conc. Ca (ppm) | Conc. Mg (ppm) | Hardness ppm as $CaCO_3$ |
|---|---|---|---|
| | | Concentrate 2 | |
| 0 | 130 | 19 | 400 |
| 0.1 | 94 | 20 | 315 |
| 0.2 | 68 | 19 | 246 |
| 0.3 | 40 | 16 | 164 |
| | | Concentrate 3 | |
| 0 | 133 | 18 | 405 |
| 0.1 | 79 | 17 | 266 |
| 0.2 | 57 | 16 | 207 |
| 0.3 | 38 | 14 | 152 |
| | | Concentrate 1 | |
| 0 | 120 | 19 | 377 |
| 0.1 | 77 | 18 | 266 |
| 0.2 | 51 | 16 | 193 |
| 0.3 | 21 | 13 | 105 |

Conclusions

1. Addition of SAS to a cutting fluid mix decreases the concentration of calcium and just barely decreases the concentration of magnesium ions.

2. The decrease of hardness of the mix is not significantly influenced by the type of product.

3. The compositions were stable, no phase separation occurred.

EXAMPLE II

Concentrate 3 was diluted with water of standard composition to a concentration of 3.5% and the cutting fluid tank of a grinding machine was filled with this aqueous metal working fluid composition. Then 0.1% of SAS was added, calculated on the composition and the influence of the SAS on the hardness of the composition with time was determined.

The results are given in the following table.

| Reaction time (in hours) | Conc. Ca (PPM) | Conc. Mg (PPM) | Hardness (PPM as $CaCO_3$) |
|---|---|---|---|
| 0 | 156 | 10 | 432 |
| 1.0 | 116 | 10 | 330 |
| 2.5 | 115 | 9 | 325 |
| 18.5 | 103 | 9 | 295 |
| 22.5 | 106 | 9 | 302 |

After letting the grinding machine dry, a thin whitish layer of SAS could be observed on the horizontal parts in the splashing zone. However this layer could be washed away quite easily.

Conclusions

1. SAS decreases the concentration of calcium ions (hardly the magnesium ion content), hence a decrease of hardness of the cutting fluid has been observed.
2. The main decrease of hardness took place within 2.5 hours after SAS addition to the cutting fluid.
3. The composition was stable; no phase separation occurred.

EXAMPLE III

The influence of the addition of SAS to an aqueous metal working fluid composition on the machining tools and on the metal article, was determined under the following conditions:

Equipment: MSI-grinder, J-wheel with A60 grain.
Material: Bars of hardened steel (58 rockwell).

| Metal working fluid: | Ca-content | Hardness as $CaCO_3$ |
|---|---|---|
| a. concentrate 3 diluted with water of standard composition to 4% concentration and next hardened with a 40% calcium nitrate solution | 95 ppm | 350 ppm |
| b concentrate 3 diluted with water of standard composition to 4% concentration and next hardened with a 40% calcium nitrate solution + 0.12% SAS addition | 81 ppm | 239 ppm |

The results (variance in surface finish ($R_A$ μm) of the bars after grinding) are given in the following table.

| without SAS | with SAS after 5 min. | with SAS | after 3 hours |
|---|---|---|---|
| 0.27 | 0.24 | $0.17^{x}$ | $0.16^{xx}$ |
| 0.40+ | 0.23 | 0.16 | 0.17 |
| 0.37+ | 0.24 | 0.16 | 0.18 |
| 0.27 | 0.24 | 0.19 | 0.17 |
| 0.30 | 0.24 | 0.17 | 0.19 |

-continued

| without SAS | with SAS after 5 min. | with SAS | after 3 hours |
|---|---|---|---|
| ($R_A$ μm) 0.32 | 0.24 | 0.16 | 0.16 |

$R_A$ = average of variance
$^{x}$same bars as were measured without SAS
$^{xx}$same bars as were measured after 5 min. with SAS
+the extreme values for the variance of 0.40 and 0.37 in the first column are probably caused by the dressing off the wheel.

The effects of the addition of SAS is a decrease in mix hardness, accompanied by an improved surface finish.

EXAMPLE IV

In a wide strip mill, the surfaces of the rolls were grinded, using a 1200 L grinding system comprising a diluted mixture of concentrate 4 as metal working fluid.

In this grinding system, which had been in use without any problems during the last couple of years, in spite of an extremely low (0.5%) apparent anionic concentration, clogging of pipes with Ca and/or Mg soaps was reported.

Samples of the spent metal working fluid and also samples of the make up mixture (containing 3% of concentrate) had a hardness of approx. 410 ppm, calculated as $CaCO_3$. The clogged pipes were cleaned.

To the system were added 1200 g of SAS. This lowered the hardness to approx. 357 ppm (as $CaCO_3$). The maximum effect on hardness of SAS addition was reached about 3 h (hours).

After 5 h (hours) a further portion of 1200 g SAS was added to the system. This gave a further decrease in hardness to approx. 285 ppm (as $CaCO_3$), which was reached about 3 h (hours) after the addition.

No clogging phenomena were observed in a 3 weeks period. Checking the surface finish of the rolls confirmed that the addition of SAS did not interfere with the grinding process.

The following data, typical for the process, were found (pathlength of measurement=0.8 mm).

| Found | Duplo | |
|---|---|---|
| Ra: 0.60 μm | 0.60 μm | (average surface roughness) |
| Rp: 2.23 μm | 2.47 μm | (height of highest point of profile above centerline) |
| Rt: 6.27 μm | 5.39 μm | (vertical height between highest and lowest point) |
| Rz: 5.10 μm | 4.80 μm | (idem for 10 point heights) |

These data show that the addition of SAS in a technical system has a suitable effect on the formation of residues without influencing the grinding effect. Periodic addition of 1200 g of SAS about every two to three weeks (added to the make up mixture) is sufficient for keeping the system in a good working condition.

EXAMPLE V

So far the experiments proved that SAS decreases the water-hardness of mix which is not broken, or has no excessive scum. It is also important to know however if a broken mix will be re-emulsified and if scum will re-dissolve after addition of SAS. As an experiment, 2 grams of SAS have been added to 100 grams of a broken mix sample of concentrate 1 with a hardness of 750 ppm as $CaCO_3$ and a concentration of 10%. After shaking and a reaction time of 16 hours the sample was visually evaluated. The same procedure was repeated for a mix of concentrate 3 in water with a hardness of 714 ppm as $CaCO_3$ and a concentration of 5%, with scum on top of the sample.

Results

After 16 hours the broken mix sample of concentrate 1 was almost homogenous, only a few small oil droplets were floating on top of the mix. The mix of concentrate 3 lost all its scum within the given reaction time.

Conclusion

SAS acts not only preventive (mix hardness reduction), but can also restore a cutting fluid which is broken, or which has excessive scum.

What is claimed is:

1. An aqueous metal working fluid composition comprising at least 80% by weight of water based on the total composition, organic lubricant and from 0.05 to 1% by weight, based on the total composition, of crystalline alkali metal aluminum silicate, of the zeolite type, having the general formula $$(A_2O)_xAl_2O_3(SiO_2)_y$$

wherein A is an alkali metal, x has a value of 0.7 to 1.5 and y has a value of 0.8 to 4, said silicate having a particle size in the range of from 0.1 to 100 μm.

2. The composition according to claim 1 wherein the silicate has a particle size in the range of from 0.1 to 15 μm.

3. The composition according to claim 2 wherein the silicate has a particle size less than 10 μm.

4. The composition according to claim 1 wherein A is sodium, x has a value from 0.7 to 1.1 and y has a value from 1.3 to 2.4.

5. The composition according to claim 1 wherein the amount of water is from 90 to 99.5% by weight based on the total composition.

6. The composition according to claim 4 wherein the amount of water is from 90 to 99.5% by weight based on the total composition.

7. The composition according to claim 1 wherein the lubricant is a synthetic organic lubricant.

8. A process for machining metal parts comprising the steps of contacting the metal with a machining tool and applying a continuous stream of an aqueous metal working fluid composition in the area where the machining tool acts upon the metal part, characterized in that the aqueous metal working fluid comprises at least 80% by weight of water based upon the metal composition, organic lubricant and from 0.05 to 1% by weight, based on the total composition, of crystalline alkali metal aluminum silicate, of the zeolite type, having the general formula $$(A_2O)_xAl_2O_3(SiO_2)_y$$

wherein A is an alkali metal, x has a value from 0.7 to 1.5 and y has a value from 0.8 to 4, said silicate having a particle size in the range of from 0.1 to 100 μm.

9. The process according to claim 8 wherein the silicate has a particle size in the range of from 0.1 to 15 μm.

10. The process according to claim 9 wherein the silicate has a particle size of less than 10 μm.

11. The process according to claim 8 wherein A is sodium, x has a value of from 0.7 to 1.1 and y has a value of from 1.3 to 2.4.

* * * * *